United States Patent [19]

Mikuni et al.

[11] Patent Number: 4,688,501

[45] Date of Patent: Aug. 25, 1987

[54] UPPER THREAD GUIDE MECHANISM FOR SEWING MACHINES

[75] Inventors: Yoshio Mikuni, Osaka; Osamu Tanaka, Hirakata; Kimikazu Matsuda, Tsuzuki, all of Japan

[73] Assignee: Maruzen Sewing Machine Co., Ltd., Osaka, Japan

[21] Appl. No.: 860,224

[22] Filed: May 2, 1986

[30] Foreign Application Priority Data

| | | | |
|---|---|---|---|
| May 7, 1985 | [JP] | Japan | 60-097375 |
| May 7, 1985 | [JP] | Japan | 60-097376 |
| Jun. 17, 1985 | [JP] | Japan | 60-092147 |
| Jun. 24, 1985 | [JP] | Japan | 60-138354 |
| Jun. 24, 1985 | [JP] | Japan | 60-096357 |
| Jul. 3, 1985 | [JP] | Japan | 60-102131 |
| Jul. 12, 1985 | [JP] | Japan | 60-107096 |
| Nov. 12, 1985 | [JP] | Japan | 60-174622 |
| Nov. 12, 1985 | [JP] | Japan | 60-174623 |
| Jan. 22, 1986 | [JP] | Japan | 61-008082 |

[51] Int. Cl.[4] ..... D05B 49/02

[52] U.S. Cl. ..... 112/241; 112/247; 112/254

[58] Field of Search ..... 112/241, 254, 57, 96, 112/247, 242

[56] References Cited

U.S. PATENT DOCUMENTS

| | | | |
|---|---|---|---|
| 704,297 | 7/1902 | Chauvet et al. | 112/241 |
| 1,938,018 | 12/1933 | H'Doubler . | |
| 2,054,498 | 9/1936 | Ebert . | |
| 2,626,580 | 1/1953 | Koenig . | |
| 3,561,002 | 2/1971 | Robert | 112/241 |
| 3,782,312 | 1/1974 | Kasuga | 112/241 |
| 4,215,641 | 8/1980 | Dobrjanskyj et al. . | |
| 4,466,371 | 8/1984 | Larsen | 112/254 |

FOREIGN PATENT DOCUMENTS

| | | | |
|---|---|---|---|
| 60-139282 | 7/1985 | Japan | 112/57 |
| 204251 | 10/1923 | United Kingdom . | |

*Primary Examiner*—Werner H. Schroeder
*Assistant Examiner*—Andrew M. Falik
*Attorney, Agent, or Firm*—Lowe, Price, Leblanc, Becker & Shur

[57] ABSTRACT

A slit (7) is formed which lies in a vertical plane and extends from an upper surface of a sewing machine frame (1) to a front surface. A tension device (5), a thread take-up spring (30), and upper and lower thread guides (23, 24) are disposed along the direction in which the slit (7) extends. A thread take-up lever (12) is installed so that it is reciprocated horizontally across the space between the pair of thread guides (23, 25). The placement of the thread in the tension device (5), thread take-up spring (30), and two thread guides (23, 24) can be attained by simply pulling the upper thread vertically downward through the slit (7). When the thread take-up lever is reciprocated, during its forward stroke it arrests the portion of the thread positioned between the two thread guides (23, 24) and draws it in V form. During its return stroke, the thread take-up lever (12) releases the thread to allow the latter to loosen in loop form.

24 Claims, 25 Drawing Figures

UPPER THREAD GUIDE MECHANISM FOR SEWING MACHINES

BACKGROUND OF THE INVENTION

1. Field of the Invention

This invention relates to an upper thread guide mechanism for a sewing machine which has an upper thread supply source and a sewing needle, and more particularly it relates to an upper thread guide mechanism which provides a path for the upper thread extending from the upper thread supply source to the sewing needle.

2. Description of the Prior Art

A sewing machine has a number of parts which must have an upper thread inserted therethrough before a sewing operation involving coordinated movement of elements such as a tension device, a thread take-up lever, a thread guide, a thread take-up spring and a sewing needle can be started. Insertion of the thread through these parts must be effected in a predetermined order. The thread inserting procedure generally comprises at least the steps of horizontally pulling the upper thread delivered from a bobbin toward the machine head, entraining it around an upper thread guide to change the direction of the upper thread, downwardly extending it across the top plate to the front side of the machine, entraining it around the tension device or thread take-up spring, changing the direction upwardly, inserting it through the thread take-up lever, pulling it downwardly, and inserting it through the needle via another thread guide. Therefore, the upper thread drawn from the bobbin must be pulled around horizontally, transversely and vertically before it can reach the needle and, furthermore, insertion of the thread through the thread take-up lever is also required. The operation of inserting the upper thread through the thread take-up lever in this manner is particularly troublesome. The actions of entraining and inserting the thread elsewhere while changing its direction are also troublesome, take much time and effort and are not easy operations, particularly for beginners in sewing operations.

SUMMARY OF THE INVENTION

This invention is intended to provide an upper thread guide mechanism for sewing machines which makes it easy to place the upper thread in a path extending from the upper thread supply source to the sewing needle.

According to this invention, there is provided an upper thread guide mechanism for a sewing machine comprising a frame, a main shaft housed in the frame and driven for rotation, an upper thread supply source, and a sewing needle. This upper thread guide mechanism provides a path for the upper thread extending from the upper thread supply source to the sewing needle and includes a pair of guides, each having a passage allowing the thread to pass therethrough and disposed a predetermined distance apart, and a thread take-up lever means adapted to be reciprocated across the pair of thread guides. The thread take-up lever is designed such that during its forward stroke its front end catches the thread between the two guides, to draw the thread while bending it in a V form. The return stroke of the thread take-up lever releases the thread.

According to this invention, if the thread is placed so that it passes through the pair of thread guides, the thread take-up level means can be caused to act on the thread in a predetermined manner without making it necessary to insert the thread through the thread take-up lever means. That is, during its reciprocating movement, the thread take-up lever means performs the function of tightening or loosening the thread by an amount of necessary for the formation of a stitch.

In a preferred embodiment of this invention, the thread take-up lever means is built in the frame of the sewing machine. The frame is formed in its front wall with a slit designed so that simply by its insertion along the slit the thread can be brought to a state of extending through the thread guides. The upper thread guide mechanism also includes a tension device for imparting tension to the upper thread and a thread take-up spring adapted to engage the upper thread to take up its slack, the tension device and thread take-up spring being positioned so that they act on the thread when the latter is passed through the slit and received in the thread guides. According to this preferred embodiment, the placement of the upper thread in the upper thread guide mechanism is attained by the simple operation of inserting the thread into the slit. Further, according to this embodiment, the parts, including the thread take-up lever means, which constitute the upper thread guide mechanism, can be built completely within the frame of the sewing machine.

The slit preferably extends vertically, so that a vertical plane extending through the slit also extends through or adjacent the needle and thread takeup lever means is horizontally reciprocated. According to such an arrangement, simply inserting the thread and pulling it downward results in the thread reaching the needle position so that there is no need to change the direction of the thread and the path for the thread in the upper thread guide mechanism can be decreased in length. The slack take-up action exerted by the thread take-up lever means and thread take-up spring is thus quickly transmitted to the needle loop. This is particularly advantageous when a highly stretchable thread is used as the upper thread.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
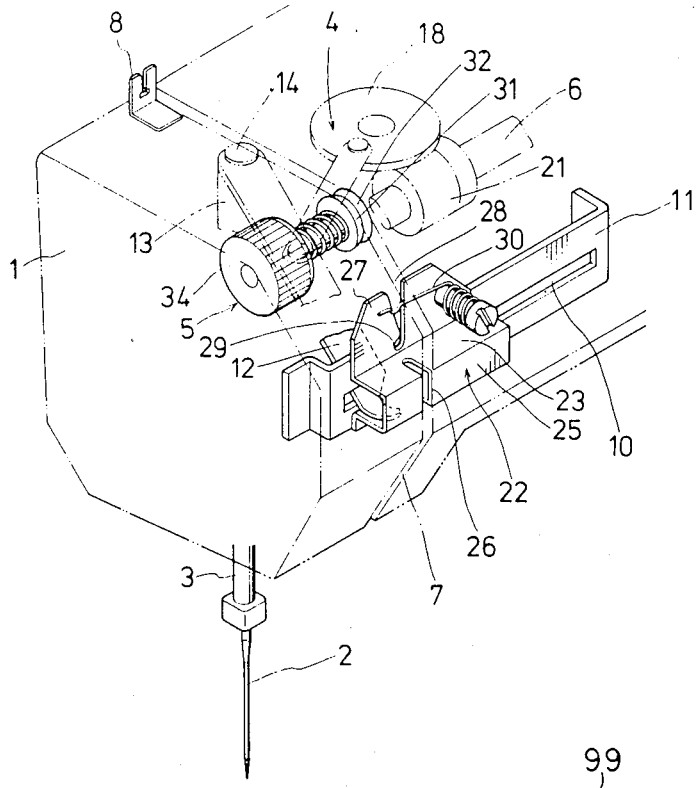
FIG. 1 is a perspective view of a portion of a sewing machine according to an embodiment of this invention.
Figure 2:
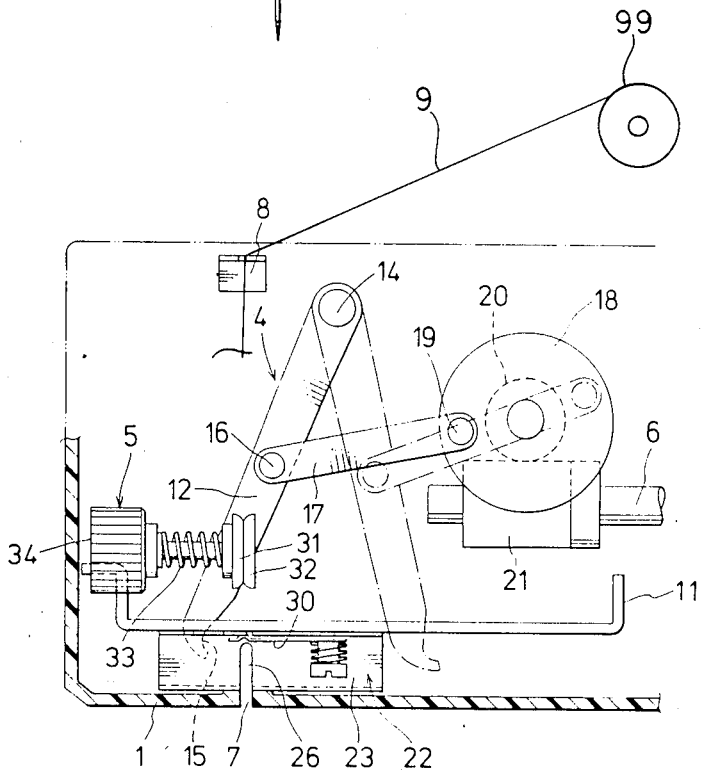
FIG. 2 is a plan view of the portion shown in FIG. 1.
Figure 3:
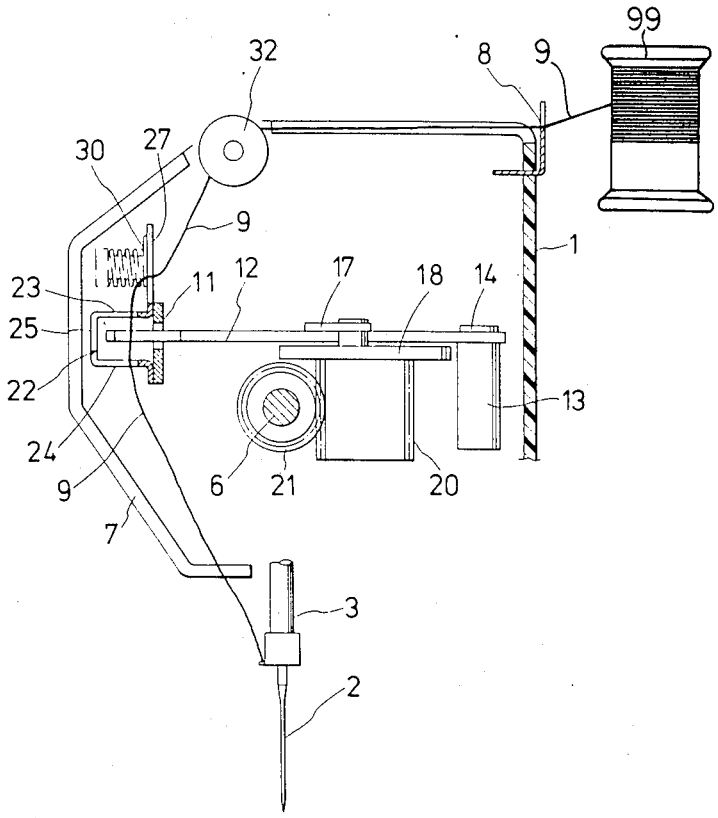
FIG. 3 is a side view of the portion shown in FIG. 1.

FIG. 1 shows a portion of a sewing machine frame 1. The portion of the sewing machine frame 1 is also shown in FIGS. 2 and 3. In these figures, the head portion at the front end of the arm portion of the frame 1 is shown. The head portion of the frame 1 is provided with a sewing needle 2 held by a movable needle bar 3 and projecting downward.

Located within the frame 1 are a thread take-up lever device 4 and a tension device 5. Further, housed in the frame 1 is a main shaft 6 adapted to be rotated to serve as a drive shaft for driving machine parts such as the needle bar 3, as is known in the art.

The frame 1 is formed at its upper and front surfaces with a slit 7 which lies in a vertical plane including the needle 2. A thread guide member 8, provided with a vertical thread guiding slot, is attached to the frame 1 so that is positioned at the read end of the horizontally extending portion of the slit 7. In this embodiment, a thread 9 (FIG. 3) drawn from a bobbin 99 is guided through the thread guide 8 and then it is inserted in the slit 7, pulled downward and inserted in the eye of the needle 2, whereby the placement of the thread is completed.

The thread take-up lever device 4 includes a guide plate 11 formed with a horizontally extending elongated opening 10 and fixed at its opposite ends to a seat (not shown) extending from the frame 1. Further, a thread take-up lever 12 is pivotally supported on a pin 14 received in a seat 13 extending from the frame 1 so that the front end of said thread take-up lever projects beyond the elongated opening 10. The front end of the thread take-up lever 12 is formed with a hook-like portion 15 that has an outwardly curved back. One end of a connecting rod 17 is pivotally connected to the intermediate portion of the thread take-up lever 12 by a pin 16. The other end of the connecting rod 17 is pivotally connected to an eccentric shaft 19 installed on a disk 18. The disk 18 has a spiral gear 20 fixedly formed on the lower portion thereof. A spiral gear 21 meshing with said spiral gear 20 is installed on the main shaft 6. With this arrangement, the rotation of the main shaft 6 is transmitted to the disk 18 to rotate the latter, whereby the thread take-up lever 12 is swung through the connecting rod 17.

A U-shaped cross-sectional member 22 formed by bending an intermediate portion into a U-shape is attached to the front surface of the guide plate 11 at a position deviated to one side of the guide plate 11 so as to cover a portion of the elongated opening 10. The U-shaped cross-sectional member 22 has a pair of substantially parallel walls 23 and 24 and a connecting wall 25 connecting them together, the U-shape opening being oriented toward the thread take-up lever 12 to receive the front end thereof. A continuous cut 26 is formed in member 22, across the connecting wall 25 and into the walls 23 and 24 so as to receive the thread 9 with the walls 23 and 24 serving as a pair of thread guides. The cut 26 is positioned to be aligned with the slit 7. A base portion connected to the upright wall 23 of the U-shaped cross-sectional member 22 is formed with a V-shaped guide groove 28 at a position associated with the slit 7 and is also formed with an eyelet 29 leading to said guide groove 28. Further, the base wall 27 is provided with a thread take-up spring 30 formed by one end of a torsion spring. This thread take-up spring 30 normally extends across the guide groove 28.

The tension device 5 is provided with a pair of regulator dishes 31 and 32 which are urged against each other for close contact by a compression spring 33. The contact surfaces of the regulator dishes 31 and 32 are positioned so that they lie in a vertical plane passing through the slit 7. The degree of close contact of the regulator dishes 32 and 32 is adjusted by turning a dial 34. A portion of the dial 34 is exposed out of the frame 1 to enable such adjustment.

As described above, the placement of the upper thread 9 is effected by the operator hooking the thread drawn out of the bobbin 99 through the guiding slot in the thread guide member 8, inserting it in the slit 7, and pulling it downwardly while pulling it toward himself. As a result, the thread 9 fits between the regulator dishes 31 and 32 and then it is guided by the guide groove 28, depressing the thread take-up spring 30 until it is inserted into eyelet 29 and cut 26 and is extended to the needle 2. The thread take-up spring 30, which is once depressed when the thread 9 is inserted in the eyelet 29, draws the thread 9 upward as it returns to its undepressed position as the tension in the thread 9 is removed. The thread take-up lever 12 may now be reciprocated by the main shaft 6. During the forward stroke of take-up lever 12 the portion of the thread 9 disposed between the upright walls 23 and 24 is caught by the hook-like portion 15 and is pulled horizontally, while during the return stroke of take-up lever 12 the thread 9 is released.

Figure 4:
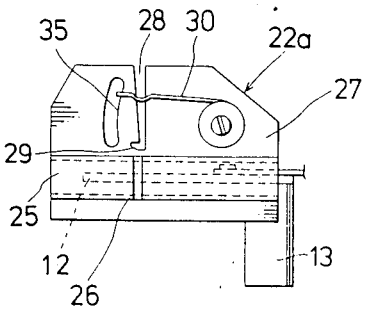
FIG. 4 is a front view of a modification of the U-shaped cross-sectional member 22 shown in FIG. 1.

A modification **22*a* of the U-shaped cross-sectional member 22 is shown in FIG. 4. The U-shaped cross-sectional member 22*a* has many points common with the aforesaid U-shaped cross-sectional member 22**; hence corresponding parts are marked with like reference numerals and a description thereof is omitted.

The base wall 27 of the U-shaped cross-sectional member 22*a* shown in FIG. 4 is formed with an arcuate groove 35 adapted to be engaged by the front end of the thread take-up spring 30. The arcuate groove 35 serves to define the range of movement of the thread take-up spring 30.

Figure 5:
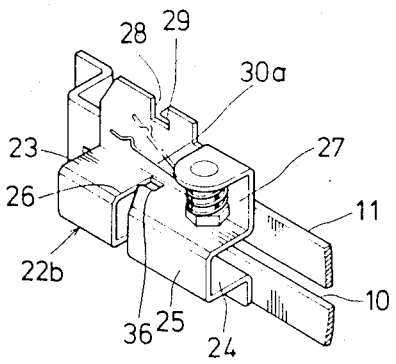
FIG. 5 is a view showing another modification of the U-shaped cross-sectional member 22 shown in FIG. 1, also showing a modification of the manner in which a thread take-up spring is installed.

FIG. 5 shows another modification 22*b* of the U-shaped cross-sectional member 22 shown in FIGS. 1 through 3. The parts corresponding to those shown in FIGS. 1 through 3 are marked with like reference numerals and a description thereof is omitted.

The cut 26 formed in the U-shaped cross-sectional member 22*b* shown in FIG. 5 is V-shaped and is formed with an eyelet 36 in the innermost position therein. Thus, the cut 26 and eyelet 36 perform the function of the guide groove 28 and eyelet 29 shown in FIGS. 1–4. Further, the guide groove 28 formed in the U-shaped cross-sectional member 22 is rather shallow. The thread take-up spring 30a is installed with the axis of its coiled portion being vertically directed and is adapted to move transversely. Normally, the thread take-up spring 30a is urged away from the base wall 27.

Figure 6:
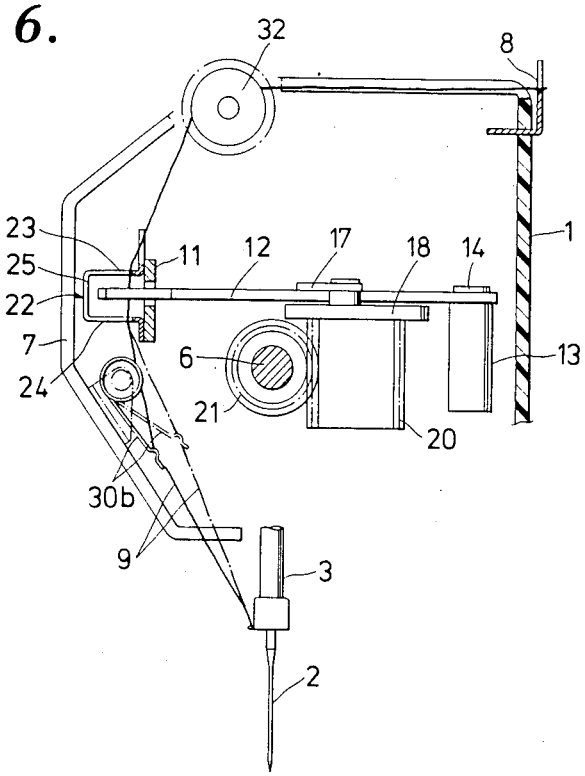
FIG. 6 is a view corresponding to FIG. 3 , showing another way of installing the thread take-up spring.

FIG. 6 shows an example in which the thread take-up spring 30*b* is attached to the inner side of the frame 1. FIG. 6 is a view corresponding to FIG. 3 and the corresponding parts are marked with like reference numerals and a description thereof is omitted.

The thread take-up spring 30*b* shown in FIG. 6 has its front end so shaped that it can be engaged by the thread 9 inserted in the slit 7. Spring 30*b* is displaced to the solid line position when the thread 9 is loose but to the phantom line position when thread 9 is pulled.

Figure 8:
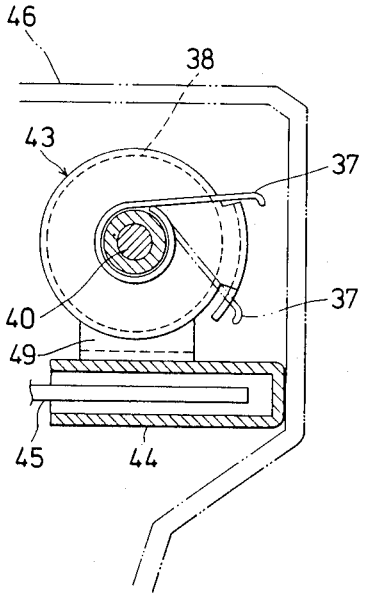
FIG. 8 is a sectional view taken along the line VIII—VIII in FIG. 7.
Figure 7:
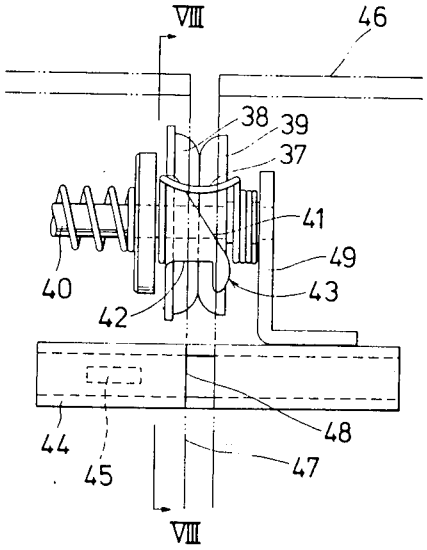
FIG. 7 is a front view showing a tension device unitized with the thread take-up spring.

A modification of the tension device is shown in FIGS. 7 and 8. In this modification, the thread take-up spring 37 is installed in connection with the regulator dishes 38 and 39. More particularly, the thread take-up spring 37, which is formed in part as a torsion spring, is held so that the torsion portion of the spring is mounted on a shaft 40 which supports the regulator dishes 38 and 39. The thread take-up spring 37 extends substantially parallel to the shaft 40 at a position opposed to the peripheral surfaces of the regulator dishes 38 and 39, so that the thread (not shown) inserted between the regulator dishes 38 and 39 is caught by the thread take-up spring 37.

In the embodiment shown in FIGS. 7 and 8, an engaging member 43 having a guide edge 41 and an engaging groove 42 is installed in connection with the thread take-up spring 37. As described above, when the thread is passed between the regulator dishes 38 and 39 and is subject to tension, the thread take-up spring 37 is displaced to the position shown in phantom lines in FIG. 8. At this time, the thread slides along the guide edge 41 until it is received in the engaging groove 42.

A U-shaped cross-sectional member 44, corresponding to the U-shaped cross-sectional member 22 shown in FIGS. 1 through 3, is adapted in the embodiment of FIGS. 7 and 8 to receive the front end of a thread take-up lever 45. Further, as shown in phantom lines, the sewing machine frame 46 is formed with a slit 47, while the U-shaped cross-sectional member 44 is formed with a notch 48 opposed to said slit 47. In addition, the contact surfaces of the regulator dishes 38 and 39 are positioned in a vertical plane passing through the slit 47. Further, the shaft 40 which supports the regulator dishes 38 and 39 constituting the tension device is held in a bracket 49 attached to the U-shaped cross-sectional member 44. In this manner, unitization is attained in which the U-shaped cross-sectional member 44 having the cut 48 serving as a thread guide, the tension device and the thread take-up spring 47 are integrated into a single unit.

When the thread take-up lever device such as the thread take-up lever 12 or 45 is reciprocated, the thread pulled during the forward stroke is loosened into loop form during the return stroke. Such loosened thread 1 is unsteady in direction, tending to get entangled around ambient projections. For example, in the embodiment shown in FIGS. 1 through 3, the direction of the loosened thread can be controlled between the guide plate 11 and the inner surface of the frame 1, so that entanglement of the thread around ambient projections can be prevented to some extent. An embodiment shown in FIGS. 9 through 12 includes a preferable arrangement for preventing the loosened thread from getting entangled around ambient projections.

Figure 10:
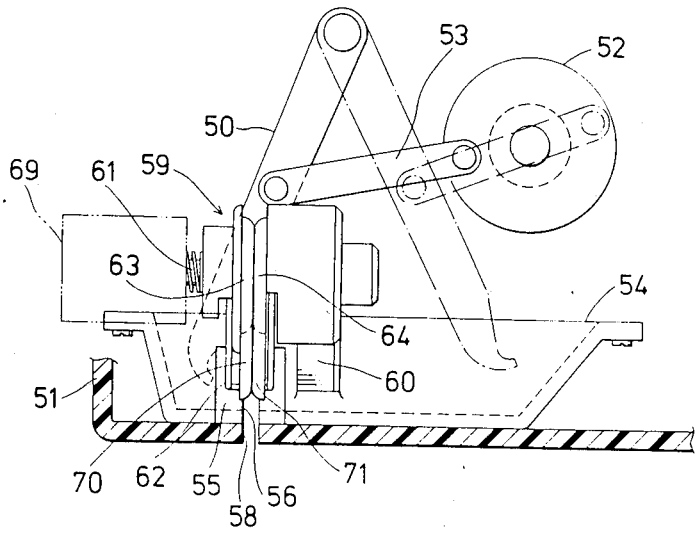
FIG. 10 is a top plan view of the portion shown in FIG. 9.

As shown in FIG. 10, a thread take-up lever 50 is swung in the same manner as the thread take-up lever 12 shown in FIG. 2. That is, the rotary motion of a disk 52 rotated by the main shaft (not shown) housed in the sewing machine frame 51 is imparted to the thread take-up lever 50 through a swinging connecting rod 53. The front end of the thread take-lever 50 is received in a support member 54 of U-shaped cross-section which opens toward the thread take-up lever 50. This embodiment is characterized in that the length of the support member 54 is such that it surrounds the front end of the thread take-up lever 50 over the range of movement of the thread take-up lever 50. The support member 54 is made, for example, of resin. The support member 54 has attached thereto a thread guide member 55 for forming a pair of thread guides which hold the thread therebetween at two vertically spaced points. The thread guide member 55 is made preferably of metal, such as iron, in consideration of wear resistance. The thread guide member 55 is formed with cuts 56 and 57 to allow the thread to pass therethrough. The sewing machine frame 51 is formed with a slit 58 in positional association with the cuts 56 and 57.

The aforesaid support member 54 is integrally formed with a bracket 60 which forms a portion of the tension device 59. The bracket 60 supports a shaft 61 on which are mounted a thread take-up spring 62, regulator dishes 63 and 64, an engaging member 65, a presser plate 66, a compression spring 67, a flange 68 and a dial 69. The dial 69 is rotatably held on the shaft 61, the rotation of said dial being transmitted to the flange 68 engaging said dial 69. The inner peripheral surface of the flange 68 is formed with an internal thread, so that the flange 68 is movable back and forth on the shaft 61 along an external thread formed on the outer peripheral surface of the shaft 61. The force with which the comprsesion spring 67 acts on the presser plate 66 is adjusted according to the position of the flange 68, whereby the holding force exerted between the pair of regulator dishes 63 and 64 is adjusted. The thread take-up spring 63 and the engaging member 65 are substantially the same as the thread take-up spring 37 and the engaging member 43, respectively, shown in FIGS. 7 and 8.

Figure 11:
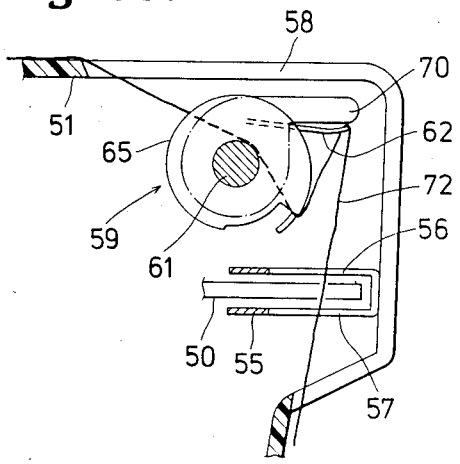
FIGS. 11 and 12 are sectional views for explaining the operation of the thread take-up spring shown in FIG. 9.
Figure 12:
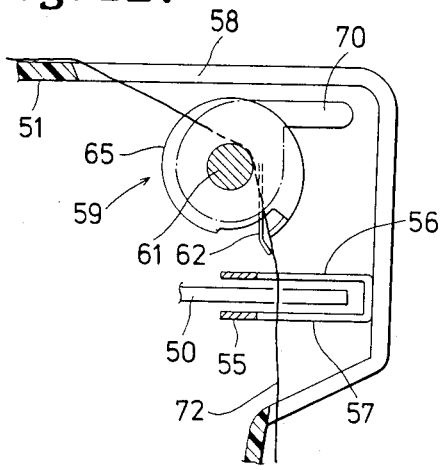

Further, in the embodiment shown in FIGS. 9 through 12, the regulator dishes 63 and 64 have extensions 70 and 71, respectively. In FIGS. 11 and 12 the upper thread 72 is shown. When this thread 72 is loosened, the thread take-up spring 62 draws back the thread 72, as shown in FIG. 11. On the other hand, when the thread 72 is pulled, the thread take-up spring 62 is displaced, as shown in FIG. 12. The aforesaid extensions 70 and 71 serve to define the terminal end of the displacement of the thread take-up spring 62 and guide the thread 72, and to ensure that when the thread 72 is inserted in the slit 58 it is also introduced between the regulator dishes 63 and 64.

In each of the embodiments shown in FIGS. 1 through 3, FIG. 5, FIG. 6, FIG. 7, FIG. 8 and FIGS. 9 through 12, respectively, the thread take-up spring is installed between the thread take-up lever and the sewing needle or very close to the thread take-up lever so as to minimize the length of the path of the thread from the thread take-up spring to the sewing needle. According to such arrangements, the thread drawing back action of the thread take-up spring ensures that slack of the needle loop passing through the loop taker is quickly absorbed, thus producing a favorable influence on the sewing conditions.

Figure 13:
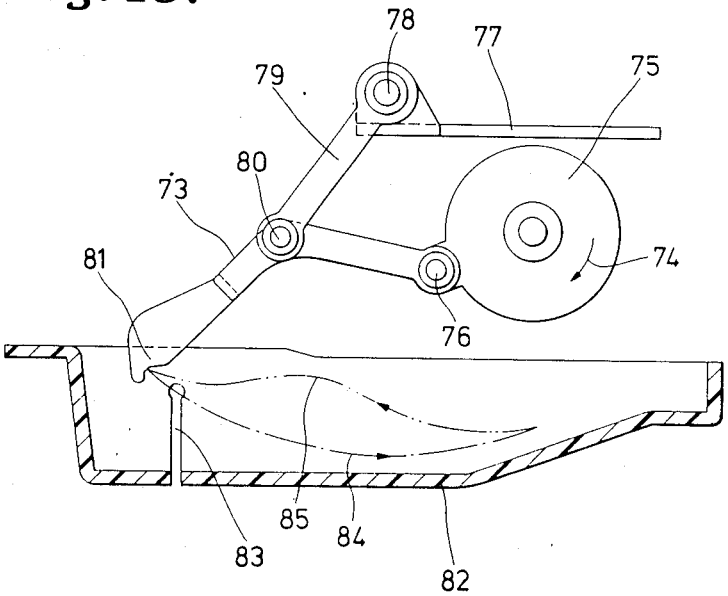
FIG. 13 is a plan view of a further embodiment of the invention, schematically showing a thread take-up lever and a mechanism for actuating the same.

In an embodiment shown in FIG. 13, the path for the forward stroke of the thread take-up lever device 73 differs from that for the return stroke thereof. More particularly, a pin 76 is installed at the eccentric position on a disk 75 adapted to be rotated in the direction of arrow 74 in operative relation to the main shaft (not shown) built in the sewing machine frame. One end of a generally L-shaped thread take-up lever device 73 is rotatably connected to the pin 76. A bracket 77 fixed to the sewing machine frame is provided with a pin 78 to which one end of a connecting link 79 is pivotally mounted. The other end of the connecting link 79 is pivotally connected to the bent portion of the thread take-up lever device 73 by a pin 80. The front end of the thread take-up lever device 73 is formed with a hook 81. There is also provided a thread guide member 82 of U-shaped cross-section which opens toward the thread take-up lever to receive the front end of the thread take-up lever device 73, the thread guide member 82 being formed with a cut 83 to allow the thread (not shown) to pass therethrough. The thread is guided so that it passes through the innermost region of cut 83.

In such an arrangement, when the disk 75 is rotated in the direction of arrow 74, the thread take-up lever device 73 performs a kind of swing motion. With attention given to the path of movement of the hook 81, it is seen that it moves along a forward path 84 during the forward stroke and a return path 85 during the return stroke. Therefore, the hook 81 intersects the innermost end of the cut 83 in the forward path to arrest the thread. On the other hand, in the return path 85 the hook 81 is positioned away from the cut 83, so that it does not engage the thread or even if it does, it only slightly engages the thread and the engaged thread easily slides along the front end of hook 81 to be immediately released.

In such an embodiment, when the thread take-up lever device 73 returns it is positively prevented from again arresting the upper thread whose slack has been absorbed as the needle loop passes through the loop taker.

As for the means for making the paths for the forward and return strokes of the thread take-up lever device differ from each other as shown in FIG. 13, a link mechanism different from the illustrated one, or a groove cam, plate cam, end cam or the like, adapted to be rotated in operative connection with the main shaft, may be installed to operate the thread take-up lever device. Further, a combination of a cam and a link mechanism may be used.

Figure 14:
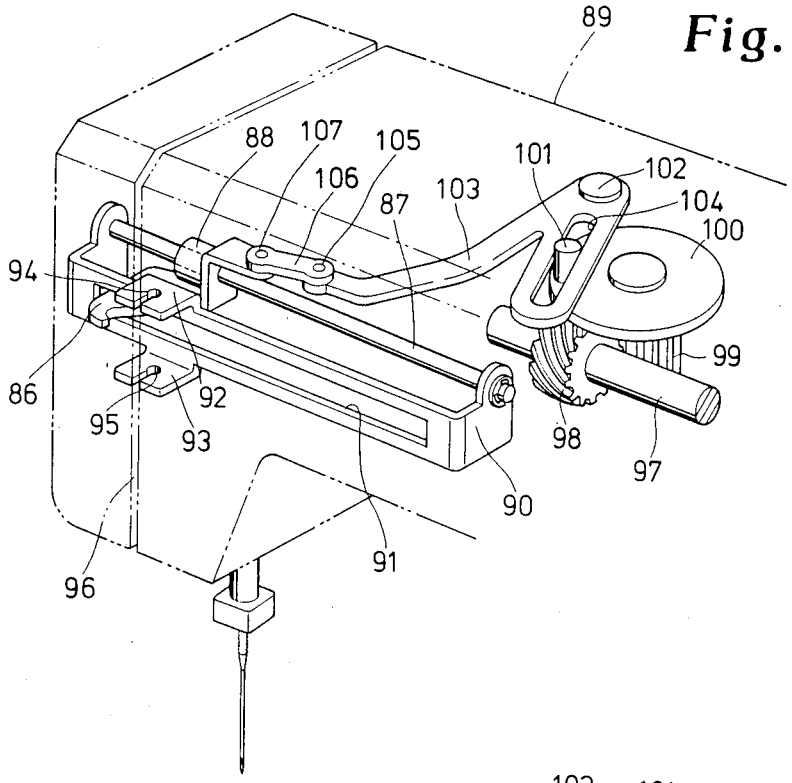
FIG. 14 is a perspective view of a portion of a sewing machine according to another embodiment of the invention.
Figure 15:
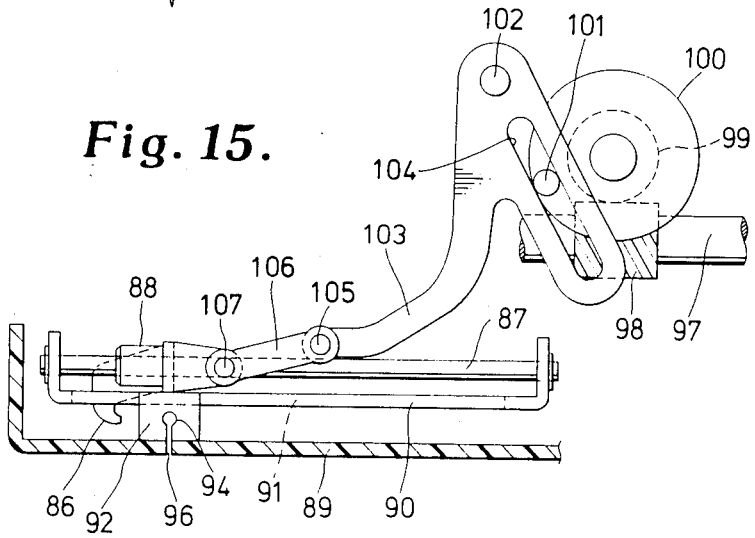
FIG. 15 is a plan view of the portion shown in FIG. 14.

An embodiment shown in FIGS. 14 and 15 is characterized by the manner in which a thread take-up lever device 86 is reciprocated, i.e., the thread take-up lever device 86 is fixed to a slider 88 slidably held on a linear guide rod 87. The guide rod 87 is attached to a guide plate 90 fixed to the sewing machine frame 89 by suitable means. The guide plate 90 is formed with an elongated opening 91 extending parallel to the guide rod 87. A pair of thread guides 92 and 93 are formed to project into a clearance between the guide plate 90 and the sewing machine frame 89. The thread guides 92 and 93 are formed with cuts 94 and 95, respectively, for passing the upper thread (not shown) therethrough, while the frame 89 is formed with a slit 96 in positional association with the cuts 94 and 95 to receive the upper thread therein and introduce it to the cuts 94 and 95.

The thread take-up lever device 86 is reciprocated across the thread guides 92 and 93 by the action of the slider 88. As in the preceding embodiments, the thread take-up lever device 86 arrests the portion of the thread positioned between the guides 92 and 93 and draws it while bending it in V form during its forward stroke, but in its return stroke it releases the thread. The slider 88 performs its sliding movement as it receives motion from the main shaft 97 housed in the frame 89. Rotation from a spiral gear 98 mounted on the main shaft 97 is transmitted to a spiral gear 99 meshing therewith, whereby a disk 100 fixed to the spiral gear 99 is rotated. A pin 101 projects from the disk 100 at an eccentric position thereon. The pin 101 fits in an elongated opening 104 formed at one end of a substantially V-shaped swing link 103 swingable around the axis of a pin 102. Thus, when the disk 100 is rotated, the swing link 103 is swung about pin 102 by the pin 101 moving within elongated opening 104. The other end of swing link 103 has one end of a connecting link 106 pivotally connected thereto by a pin 105. The other end of the connecting link 106 is pivotally connected to the slider 88 through a pin 107. The aforesaid swing movement of the swing link 103 is transmitted to the slider 88 through the connecting link 106, whereby slider 88 is reciprocated on the guide rod 87.

Figure 16:
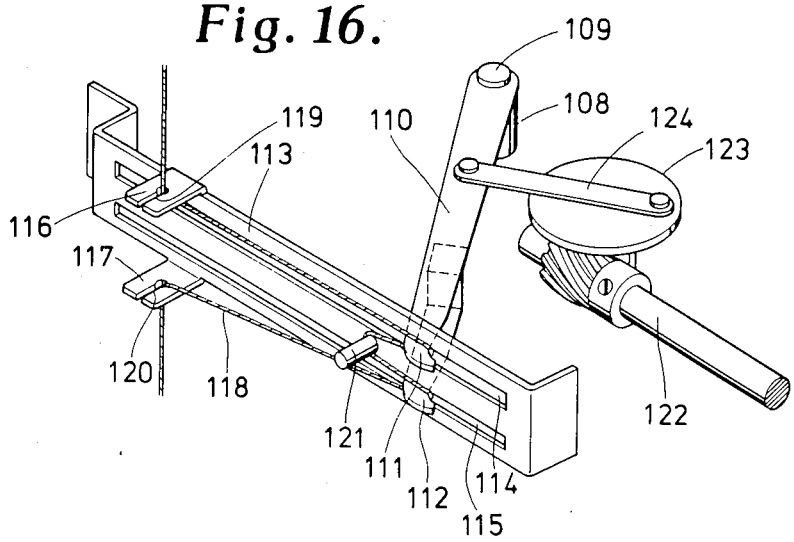
FIG. 16 is a perspective view of another embodiment of the invention showing a thread take-up lever and its associated arrangement.
Figure 17:
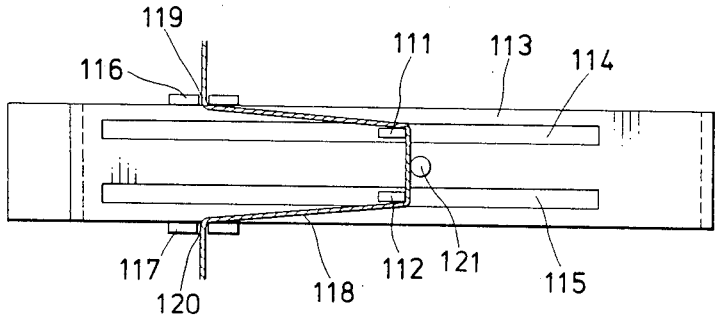
FIGS. 17 and 18 are front views showing the operation attained when the thread take-up lever shown in FIG. 16 draws the thread.
Figure 18:
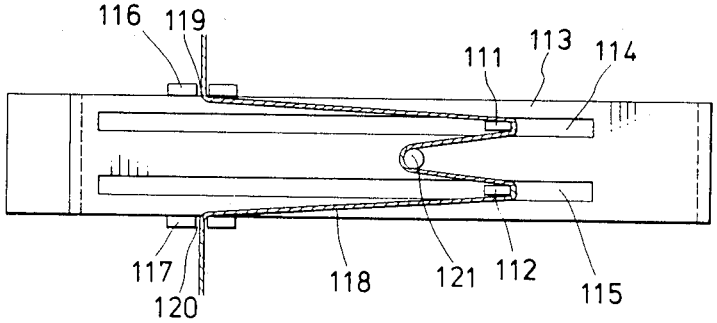

An important problem to be solved in reducing the size of a sewing machine is to minimize the stroke of movement of the thread take-up lever. An embodiment shown in FIGS. 16 through 18 is designed to provide a solution to this problem. However, the thread take-up lever cannot be simply reduced in size, for if the stroke of movement of the thread take-up lever is reduced it becomes impossible to supply the amount of thread required for the needle loop to pass through the loop taker. Likewise, with a reduced take-up lever it is not possible to draw back the loosened thread by passing through the loop taker to absorb the slack of the stitched upper thread to properly tighten the thread. In this embodiment, the stroke of movement of the thread take-up lever can be reduced without impairing the function of the thread take-up lever.

Referring to FIG. 16, a thread take-up lever 110 pivotally supported at one end thereon by a pin 109 on a seat 108 provided in a sewing machine body has its front end bifurcated to provide two hook-like portions 111 and 112. These hook-like portions 111 and 112 project through two elongated openings 114 and 115, respectively, formed in a guide plate 113 installed inside the sewing machine frame (not shown). The guide plate 113 is provided with a pair of vertically opposed thread guides 116 and 117 projecting therefrom, said thread guides 116 and 117 being formed with cuts 119 and 120, respectively, through which the upper thread 118 is passed. Further, the guide plate 113 is provided with a projection 121 projecting between the elongated openings 114 and 115.

The thread take-up lever 110 is swung as it receives motion from the main shaft 112 through the disk 123 and connecting rod 124, as in the case of the embodiment shown in FIGS. 1 through 3. When such thread take-up lever 110 is reciprocated, during its forward stroke the hook-like portions 111 and 112 arrest and draw the portion of the thread 118 positioned between the thread guides 116 and 117, as shown in FIG. 17. Further, when the thread take-up lever 110 is reciprocated, the thread 18 is caught by the projection 121 and thereby bent in an M form, as shown in FIG. 18.

Figure 19:
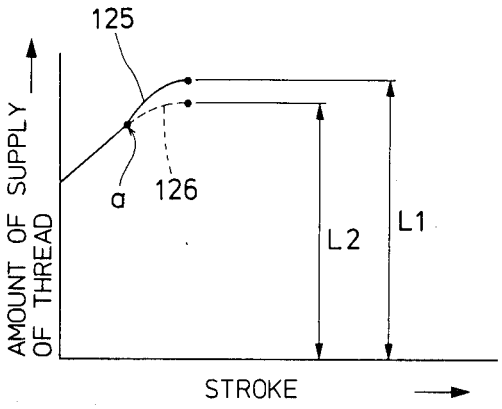
FIG. 19 is a graph showing the relation of the amount of supply of thread with respect to the stroke of the thread take-up lever in FIG. 16.

FIG. 19 is a graph showing the amount of supply of thread 118 with respect to the stroke of the thread take-up lever 110. The thread 118, which is supplied from the thread supply source as the thread take-up lever 110 is reciprocated, comes in contact with the projection 121 at the stage shown in FIG. 17. This position of take-up lever 110 corresponds to the point indicated by "a" in FIG. 19. When the thread take-up lever 110 is further forwardly moved, as shown in FIG. 18, the amount of supply of thread is depicted by a solid line curve 125. That is, from the point "a" the amount of supply of thread increases and, finally, the amount of supply of thread shown by L1 can be obtained. On the other hand, a curve 126 shown in dotted line corresponds to the absence of the projection 121, and the amount of supply of thread which is finally obtained in that case is smaller, as shown at L2. It is thus seen that if the amount of stroke of the thread take-up lever 110 is the same, a larger amount of supply of thread can be obtained by providing the projection 121. This means, conversely, that if the same amount of supply of thread is to be obtained, the amount of stroke of the thread take-up lever can be reduced.

Figure 20:
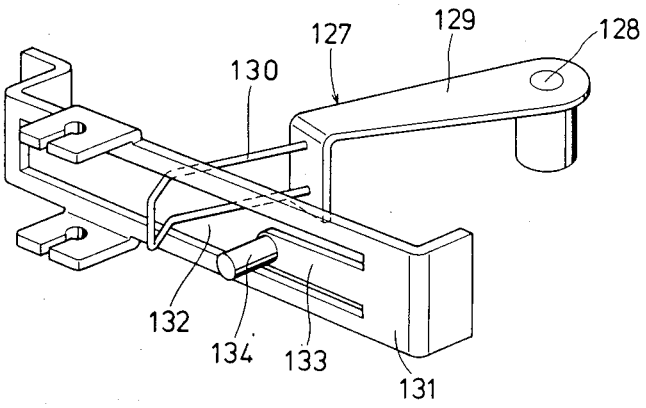
FIG. 20 is a perspective view of a modification of the thread take-up lever shown in FIG. 16.

FIG. 20 shows a thread take-up lever 127 different in construction from the thread take-up lever 110 shown in FIG. 16. The thread take-up lever 127 comprises a main body 129 mounted for pivotal movement around the axis of a pin 128, and a thread engaging portion 130 in the form, for example, of a wire bent in substantially U form attached to extend from the main body 129. A guide plate 131 is formed with a relatively wide elongated opening 132 and a tongue 133 extending from one lateral edge defining said elongated opening 132. The tongue 133 is provided with a projection 134. The thread engaging portion 130 of the thread take-up lever 127 passes over the projection 134 during the forward movement thereof until it approaches one lateral edge of the elongated opening 132.

Also in the embodment shown in FIG. 20, the thread (not shown) arrested by the thread engaging portion 130 is bent in M form after it has been caught by the projection 134.

Figure 21:
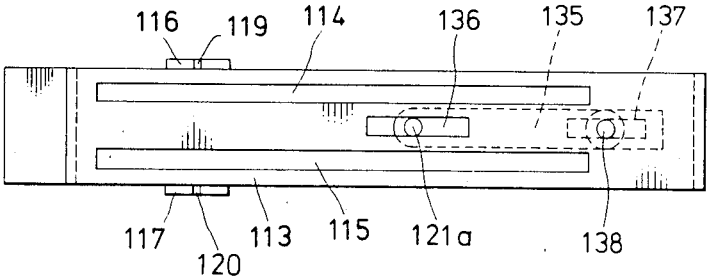
FIG. 21 is a front view of a modification of the guide plate shown in FIG. 16.

FIG. 21 shows an example in which the projection 121 shown in FIG. 17, for example, is adapted to have its position adjusted. In FIG. 21, the portions corresponding to those shown in FIG. 17 are marked with like reference numerals, and a repetition of the same explanation thereof is omitted.

Referring to FIG. 21, a projection **121*a* is provided on an adjustment plate 136. The adjustment plate 135 is formed with a longitudinally extending stop opening 137, and is fixed to the guide plate 113 by a set-screw 138 which extends through said stop opening 137 and an elongated hole formed in the guide plate 113. Thus, the position of the projection 121*a* is adjusted within the range defined by the guide opening 136 or stop opening 137. By means of this adjustment, the position of the point "a" shown in FIG. 19** is changed and the amount of supply of thread is adjusted as a whole.

According to the embodiment shown in FIGS. 16 through 18, FIG. 20, and FIG. 21, the amount of thread supplied in response to the forward movement of the thread take-up lever is increased at the final stage, thus providing an advantage that the performance of absorbing a slack of the thread is further improved.

In each of the embodiments shown in FIGS. 16 through 21, the thread take-up lever has two thread engaging portions; however, it may have three or more thread engaging portions and projections may be disposed each between adjacent paths of travel of the engaging portions.

Further, substantially the same arrangement as in each of the embodiments shown in FIGS. 16 through 21 may be applied to the thread take-up lever device designed for linear movement shown in FIGS. 14 and 15.

Figure 22:
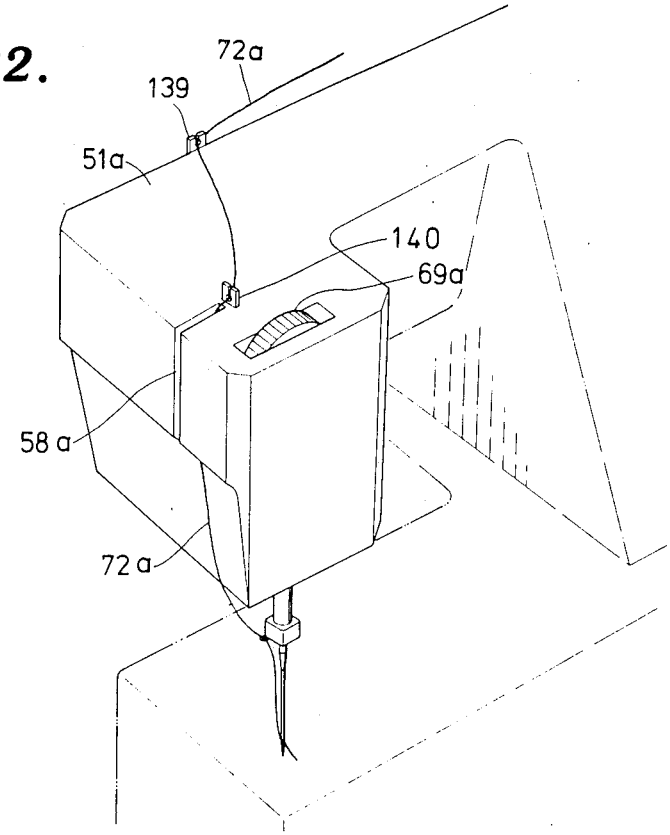
FIG. 22 is a perspective view of a portion of a sewing machine according to another embodiment of the invention.
Figure 23:
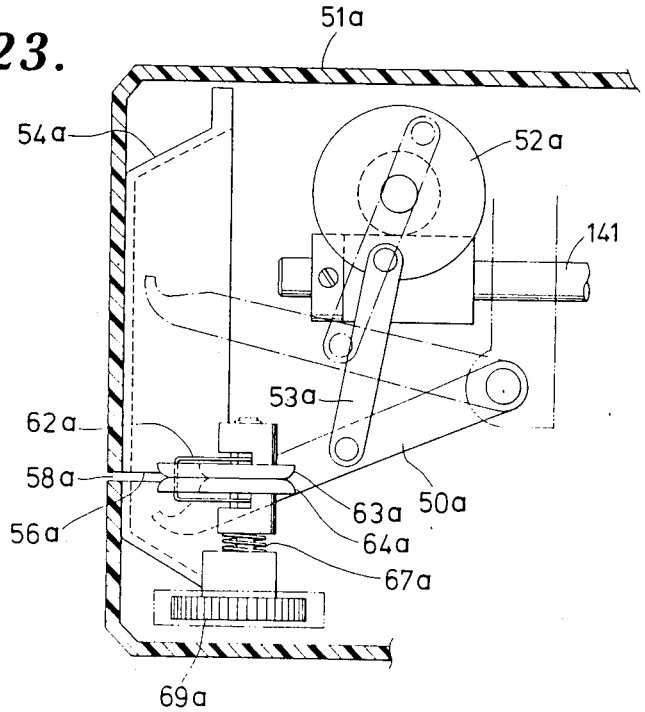
FIG. 23 is a plan view of the portion shown in FIG. 22, with the upper wall of the sewing machine removed for the sake of illustration.

In an embodiment shown in FIGS. 22 and 23, the left-hand side surface of the sewing maching frame **51*a* is formed with a slit 58*a* through which the thread 72*a* is passed, whereby the predetermined placement of the thread is achieved. Thus, the thread 72*a* unwound from the bobbin (not shown) is passed through a first thread guide member 139 installed at the rear end of the upper surface of the sewing machine frame 51*a* and then through a second thread guide member 140 installed adjacent the upper end of the slit 58*a* and is then inserted in the slit 58*a***.

Figure 9:
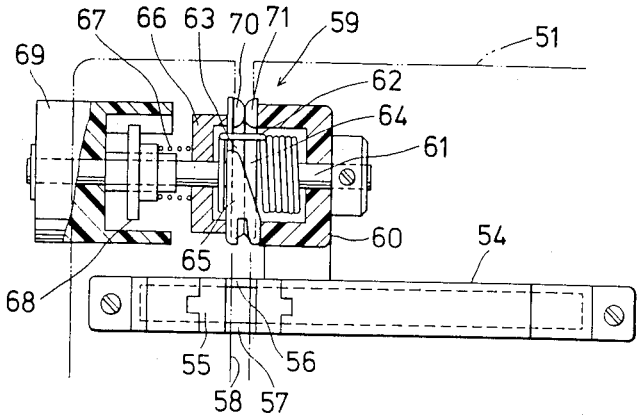
FIG. 9 is a front view of a portion of a sewing machine according to another embodiment of the invention.

Referring particularly to FIG. 23, the rotation of a main shaft 141 is transmitted to a disk **52*a*, the mechanism for transmission of power from said disk 52*a* to a thread take-up lever 50*a* being substantially the same as in the embodiment shown in FIG. 10. Further, most of the rest of the arrangement is substantially the same as in the embodiment shown in FIG. 10, the only difference being in direction. Therefore, in FIGS. 22 an 23, the reference numerals used in FIG. 10 and in FIG. 9 showing the same embodiment are used with the suffix "a" to indicate the corresponding parts, and a repetition of the same explanation is omitted. In the embodiment shown in FIGS. 22 and 23, the thread take-up lever 50*a* is installed to extend toward the left-hand side surface of the frame 51*a* and is adapted to be reciprocated substantially perpendicular to the direction of the main shaft 141. Further, a support member 54*a* forming a thread guide is installed to extend longitudinally along the left-hand side surface of the frame 51*a*, while a dial 69*a* is installed for exposure on the upper surface of the frame 51*a***.

Figure 24:
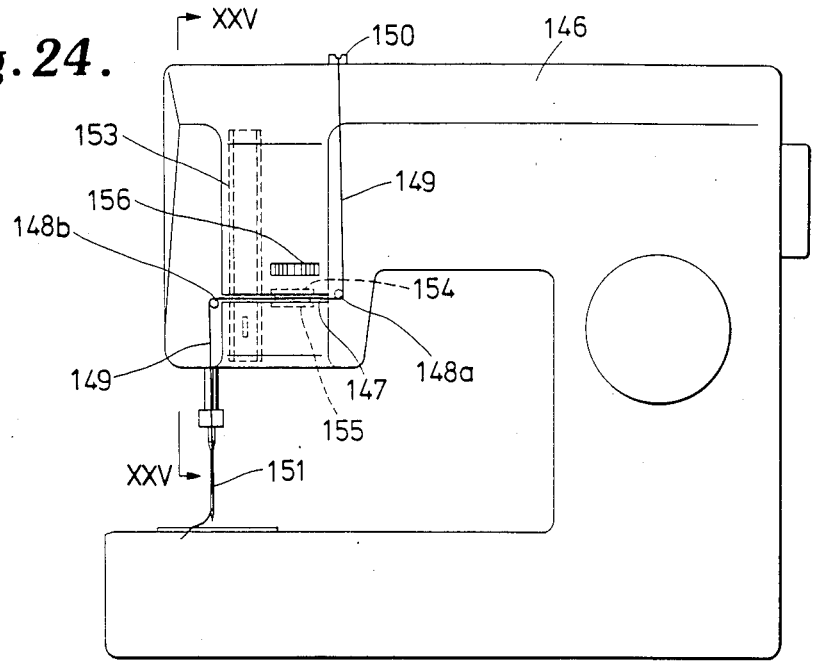
FIG. 24 is a schematic front view of another embodiment of the invention.
Figure 25:
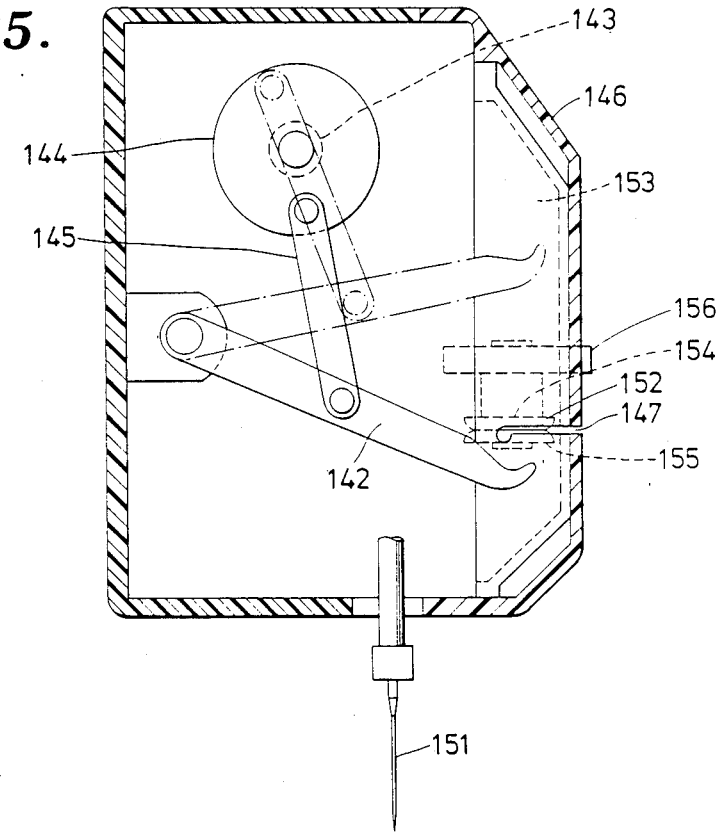
FIG. 25 is an enlarged sectional view taken along the line XXV—XXV in FIG. 24.

An embodiment shown in FIGS. 24 and 25 is arranged so that a thread take-up lever 142 is swung in a vertical plane. To actuate such a thread take-up lever 142, there is provided a disk 144 which is coaxial with the main shaft 143 and to which the rotation of the main shaft 143 is transmitted, the rotation of disk 144 being converted into a reciprocating movement by a connecting rod 145, which reciprocating movement is transmitetd to the thread take-up lever 142.

The front surface of the sewing machine frame 146 is formed with a horizontally extending slit 147, and guide members 148*a* and 148*b* are installed adjacent the opposite ends of said slit 147. The upper thread 149 is withdrawn from the bobbin (not shown) and then entrained around a thread guide member 150 provided on the upper surface of the frame 146, whereupon it is led downwardly and entrained around the thread guide member 148*a*. Substantially, the thread 149 is led to the left as viewed in FIG. 24 and entrained around another thread guide 149*b* so that it is inserted in the slit 147, and then led to the needle 151.

A cut 152 which serves as thread guide means is provided in positional association with the slit 147.

The cut 152 is formed in a U-shaped cross-sectional member 153 which vertically extends to surround the range of movement of the front end of the thread take-up lever 142. A pair of regulator dishes 154, 155 forming a portion of the tension device are provided in positional association with the slit 147, and a dial 156 for adjusting the pressing force of said tension device exerted on the upper thread 149 is installed on the front surface of the frame 146 so that it is exposed.

In an embodiment shown in FIGS. 24 and 25, when a thread take-up lever 142 is turned upward, it arrests the thread 149, while it releases the thread 149 when it is turned downward. However, this operative relationship may be reversed.

Although the present invention has been described and illustrated in detail, it is clearly understood that the same is by way of illustration and example only and is not to be taken by way of limitation, the scope of the present invention being limited only by the terms of the appended claims.

What is claimed is:

1. An upper thread guide mechanism for a sewing machine having a frame, a rotatable main shaft housed in the frame and adapted to be rotated therein, an upper thread supply source and a sewing needle, said upper thread guide mechanism providing a path for an upper thread extending from the upper thread source to the sewing needle, comprising:

a pair of spaced-apart thread guide means having a through passage for allowing said upper thread to pass therethrough and disposed with a predetermined space therebetween, said through passage being laterally opened for enabling said upper thread to be received therein;

a thread take-up lever means, having a portion adapted to be reciprocated in a direction substantially perpendicular to the laterally opened direction of said through passage and across said space between said pair of thread guide means such that during a forward motion of said take-up lever means a front end thereof arrests a portion of said upper thread disposed between said pair of thread guides and draws said upper thread while bending the same into a V-form and during a return motion said take-up lever stops drawing said upper thread;

tension means for imparting tension to said upper thread positioned between said thread guide means and said upper thread supply source, said tension means comprising a pair of regulator means for holding said upper thread therebetween; and said through passage of said thread guide means being positioned to have said upper thread passed therethrough when said upper thread is held between said pair of regulator means and drawn out from between said regulator means on a plane extending through said passage.

2. A mechanism as set forth in claim 1, wherein said reciprocating portion of said thread take-up lever means comprises a thread take-up lever adapted to be swung by driving motion from said main shaft such that a front end of said thread take-up lever moves to arrest said upper thread.

3. A mechanism as set forth in claim 1, wherein said reciprocating portion of said thread take-up lever means is slidably mounted to said frame for reciprocating linear motion on a linear guide rod, and said mechanism further comprises a link mechanism, whereby sliding motion is imparted from said main shaft to said reciprocating portion of said thread take-up lever means.

4. A mechanism as set forth in claim 1, wherein said through passage formed in each of said thread guide means is defined by a groove cut into an edge of each of said pair of thread guide means.

5. A mechanism as set forth in claim 4, wherein said pair of thread guide means are formed by the pair of substantially parallel walls of a U-shaped cross-sectional member opening toward said thread take-up lever means to receive said front end of said thread take-up lever means and having a connecting wall connecting said substantially parallel walls, and said grooves formed in said pair of thread guide means for allowing said upper thread to pass therethrough are formed by a cut extending continuously across said connecting wall of said U-shaped cross-sectional member and into each of said substantially parallel walls.

6. A mechanism as set forth in claim 4, wherein said thread guide means and said thread take-up lever means are supported inside said frame of said sewing machine, and said frame is formed with a slit at a position corresponding to said grooves of said thread guide means which grooves allow said upper thread to pass therethrough.

7. A mechanism as set forth in claim 6, wherein said slit extends substantially linearly at least on a front surface of said frame.

8. A mechanism as set forth in claim 6, wherein said slit extends horizontally substantially linearly at least on said front surface of said frame.

9. A mechanism as set forth in claim 6, wherein said slit extends vertically substantially linearly at least on lateral surface of said frame.

10. A mechanism as set forth in claim 6, further comprising a thread take-up spring adapated to engage said upper thread to absorb any slack thereof, said tension means having a pair of regulator dishes for holding said upper thread therebetween, said regulator dishes being positioned to hold said upper thread therebetween when said upper thread is inserted in said slit, said thread take-up spring being positioned to engage said upper thread inserted into said slit.

11. A mechanism as set forth in claim 10, wherein said pair of regulator dishes are provided with extensions which project in the direction of said slit.

12. A mechanism as set forth in claim 1, wherein said pair of thread guides means are formed to have a pair of substantially parallel walls which are disposed with a predetermined space therebetween to receive said front end of said thread take-up lever means, said pair of walls having a length such as to freely accommodate said front end of the thread take-up lever means therebetween over the operating range of reciprocating movement of said thread take-up lever means.

13. A mechanism as set forth in claim 1, further comprising a thread take-up spring adapted to engage said upper thread to absorb any slack thereof, and said tension means and said thread take-up spring being attached to said thread guide means, whereby said thread guide means, said tension means and said thread take-up spring are utilized.

14. A mechanism as set forth in claim 1, further comprising a thread take-up spring adapted to engage said upper thread to absorb any slack thereof, said thread take-up spring being disposed adjacent said thread guide means and positioned to engage said upper thread extending straight through said through passage.

15. A mechanism as set forth in claim 1, wherein said pair of thread guide means are disposed in horizontally opposed relation to each other, and said thread take-up lever means is vertically reciprocated.

16. A mechanism as set forth in claim 1, wherein said front end of said thread take-up lever means is formed with at least two thread-engaging portions to engage said upper thread in at least two places thereon, and comprises a member disposed between the paths of said thread-engaging portions moving with the reciprocating movement of said thread take-up lever means, said member being adapted to engage said upper thread to thereby bend the same during said forward motion of said thread take-up lever means.

17. An upper thread guide mechanism for a sewing machine having a frame, a rotatable main shaft housed in the frame and adapted to be rotated therein, an upper thread supply source and a sewing needle, said upper thread guide mechanism providing a path for an upper thread extending from the upper thread source to the sewing needle, comprising:

a pair of spaced-apart thread guide means having a through passage for allowing said upper thread to pass therethrough and disposed with a predetermined space therebetween, and a thread take-up lever means, having a portion adapted to be reciprocated across said space between said pair of thread guide means such that during a forward motion of said take-up lever means a front end thereof arrests a portion of said upper thread disposed between said pair of thread guides and draws said upper thread while bending the same into a V-form and during a return motion said take-up lever releases said upper thread, wherein said reciprocating portion of said thread take-up lever means has a first side which is directed forward during a forward stroke and a second side which is directed forward during a return stroke, and said second side is shaped such that when the thread is engaged thereby during said return stroke of said thread take-up lever means said second side allows said upper thread to pass thereover as the thread take-up lever means is moved.

18. A mechanism as set forth in claim 17, wherein said first side of the thread take-up lever means is formed with a hook-like portion while said second side is formed with a forwardly bulging curved portion.

19. An upper thread guide mechanism for a sewing machine having a frame, a rotatable main shaft housing in the frame and adapted to be rotated therein, an upper thread supply source, and a sewing needle, said upper thread guide mechanism providing a path for an upper thread extending from the upper thread source to the sewing needle, comprising:

a pair of spaced-apart thread guide means having a through passage for allowing said upper thread to pass therethrough and disposed with a predetermined space therebetween, and a thread take-up lever means, having a portion adapted to be reciprocated across said space between said pair of thread guide means such that during a forward motion of said take-up lever means a front end thereof arrests a portion of said upper thread disposed between said pair of thread guides and draws said upper thread while bending the same into a V-form and during a return motion said take-up lever releases said upper thread, wherein said pair of thread guide means are disposed in vertically opposed relation to each other, and said thread take-up lever means is horizontally reciprocated.

20. A mechanism as set forth in claim 19, wherein said thread take-up lever means is reciprocated in a direction substantially parallel to the direction in which said main shaft extends.

21. A mechanism as set forth in claim 19, wherein said thread take-up lever means is reciprocated in a direction substantially perpendicular to the direction in which said main shaft extends.

22. An upper thread guide mechanism for a sewing machine having a frame, a rotatable main shaft housed in the frame and adapted to be rotated therein, an upper thread supply source and a sewing needle, said upper thread guide mechanism providing a path for an upper thread extending from the upper thread source to the sewing needle, comprising:

a pair of spaced-apart thread guide means having a through passage for allowing said upper thread to pass therethrough and disposed with a predetermined space therebetween, and a thread take-up lever means, having a portion adapted to be reciprocated across said space between said pair of thread guide means such that during a forward motion of said take-up lever means a front end thereof arrests a portion of said upper thread disposed between said pair of thread guides and draws said upper thread while bending the same into a V-form and during a return motion said take-up lever releases said upper thread, wherein said reciprocating portion of said thread take-up lever means has a return motion different from its forward motion, and during said return motion is moved away from that portion of said upper thread which is located between said two thread guide means.

23. An upper thread guide mechanism for a sewing machine having a frame, a rotatable main shaft housed in the frame and adapted to be rotated therein, an upper thread supply source and a sewing needle, said upper thread guide mechanism providing a path for an upper thread extending from the upper thread source to the sewing needle, comprising:

tension means for imparting tension to said upper thread;

a thread take up spring adapted to engage said upper thread to absorb any slack thereof;

thread take-up lever means for taking up said thread, having a portion adapted to be reciprocated by driving motion from said main shaft such that during a forward motion of said take-up lever means a front end thereto arrests a portion of said upper thread and draws said upper thread; and a pair of spaced-apart thread guide means having a through passage for allowing said upper thread to pass therethrough and across the reciprocating motion of said take-up lever means and disposed with a predetermined space for allowing said front end of said thread take-up lever means to be reciprocated therebetween, said tension means, said thread take-up spring, said thread take-up lever means and said thread guide means being supported inside said frame; and said frame being formed with a slit at a position corresponding to said through passage of said thread guide means.

24. An upper thread guide mechanism for a sewing machine having a frame, a rotatable main shaft housed in the frame and adapted to be rotated therein, an upper thread supply source and a sewing needle, said upper thread guide mechanism providing a path for an upper thread extending from the upper thread source to the sewing needle, comprising:

tension means for imparting tension to said upper thread;

a thread take up spring adapted to engage said upper thread to absorb any slack thereof;

thread take-up lever means for taking up said thread, having a portion adapted to be reciprocated by driving motion from said main shaft such that during a forward motion of said take-up lever means a front end thereto arrests a portion of said upper thread and draws said upper thread; and a pair of spaced-apart thread guide means having a through passage for allowing said upper thread to pass therethrough and across the reciprocating motion of said take-up lever means and disposed with a predetermined space for allowing said front end of said thread take-up lever means to be reciprocated therebetween, said path for said upper thread having a portion extending substantially linearly; and said tension means, said thread take-up spring, said thread take-up lever means and said thread guide means being arranged along said linearly extending portion of said path for said upper thread in this sequence.

* * * * *